US008395309B2

(12) United States Patent
Wei et al.

(10) Patent No.: US 8,395,309 B2
(45) Date of Patent: Mar. 12, 2013

(54) ELELCTRON EMITTER AND ELECTRON EMISSION ELEMENT

(75) Inventors: Yang Wei, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/981,571

(22) Filed: Dec. 30, 2010

(65) Prior Publication Data

US 2012/0133266 A1 May 31, 2012

(30) Foreign Application Priority Data

Nov. 29, 2010 (CN) ..... 2010 1 0564701

(51) Int. Cl.
*H01J 63/04* (2006.01)

(52) U.S. Cl. ..... 313/496; 313/309; 313/311; 313/351

(58) Field of Classification Search ..... None
See application file for complete search history.

(56) References Cited

U.S. PATENT DOCUMENTS

| | | | | |
|---|---|---|---|---|
| 7,812,511 | B2 * | 10/2010 | Liu et al. | 313/495 |
| 7,863,806 | B2 * | 1/2011 | Wei et al. | 313/495 |
| 7,997,950 | B2 * | 8/2011 | Wei et al. | 445/50 |
| 8,106,576 | B1 * | 1/2012 | Wei et al. | 313/495 |
| 2008/0012466 | A1 | 1/2008 | Yang et al. | |
| 2010/0055338 | A1 | 3/2010 | Kim et al. | |
| 2010/0072872 | A1 * | 3/2010 | Legagneux et al. | 313/2.1 |
| 2010/0104808 | A1 | 4/2010 | Fan et al. | |
| 2010/0329501 | A1 | 12/2010 | Liu et al. | |

FOREIGN PATENT DOCUMENTS

| | | | |
|---|---|---|---|
| CN | 1877774 | A | 12/2006 |
| CN | 101097829 | | 1/2008 |
| CN | 101425435 | | 5/2009 |
| CN | 101764007 | A | 6/2010 |
| CN | 1988108 | | 9/2010 |
| CN | 101931842 | A | 12/2010 |
| JP | 2010188493 | A | 9/2010 |

* cited by examiner

*Primary Examiner* — Ashok Patel
(74) *Attorney, Agent, or Firm* — Altis Law Group, Inc.

(57) ABSTRACT

The present disclosure provides an electron emitter. The electron emitter includes a carbon nanotube pipe. One end of the carbon nanotube pipe has a plurality of carbon nanotube peaks. The present disclosure also provides an electron emission element. The electron emission element comprises a conductive base and a carbon nanotube pipe. The carbon nanotube pipe includes a first end electrically connected with the conductive base and a second end opposite to the first end. The second end defines an opening and includes a plurality of tapered carbon nanotube bundles located around the opening.

20 Claims, 10 Drawing Sheets

ELELCTRON EMITTER AND ELECTRON EMISSION ELEMENT

CROSS-REFERENCE TO RELATED APPLICATIONS

This application claims all benefits accruing under 35 U.S.C. §119 from China Patent Application No. 201010564701.X, filed on Nov. 29, 2010 in the China Intellectual Property Office, the disclosure of which is incorporated herein by reference. This application is related to applications entitled, "METHOD FOR MAKING ELELCTRON EMITTER", filed on Dec. 30, 2010, Ser. No. 12/981,579; and "ELELCTRON EMITTER AND ELECTRON EMISSION ELEMENT", filed on Dec. 30, 2010, Ser. No. 12/981,580.

BACKGROUND

1. Technical Field

The present disclosure relates to an electron emitter and an electron emission element.

2. Description of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios greater than 1000), and a tip-surface area near the theoretical limit (the smaller the tip-surface area, the more concentrated the electric field, and the greater the field enhancement factor). These features tend to make CNTs ideal candidates for electron emitters.

A carbon nanotube wire is provided as an electron emitter. The electron emitter includes a carbon nanotube wire and a conductive base. The carbon nanotube wire includes a first end and a second end oriented to the first end. The first end of the carbon nanotube wire is connected to the conductive base. The second end of the carbon nanotube wire extends from a surface of the conductive base along a direction far from the conductive base. A number of electrons can be emitted from the second end of the carbon nanotube wire. However a cross section of the second end of the carbon nanotube wire is a planar because the carbon nanotube wire is formed by cutting a longer carbon nanotube wire. Therefore, the field emission characteristic of the carbon nanotube wire is bad.

What is needed, therefore, is to provide an electron emitter and an electron emission element having improved field emission characteristics.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
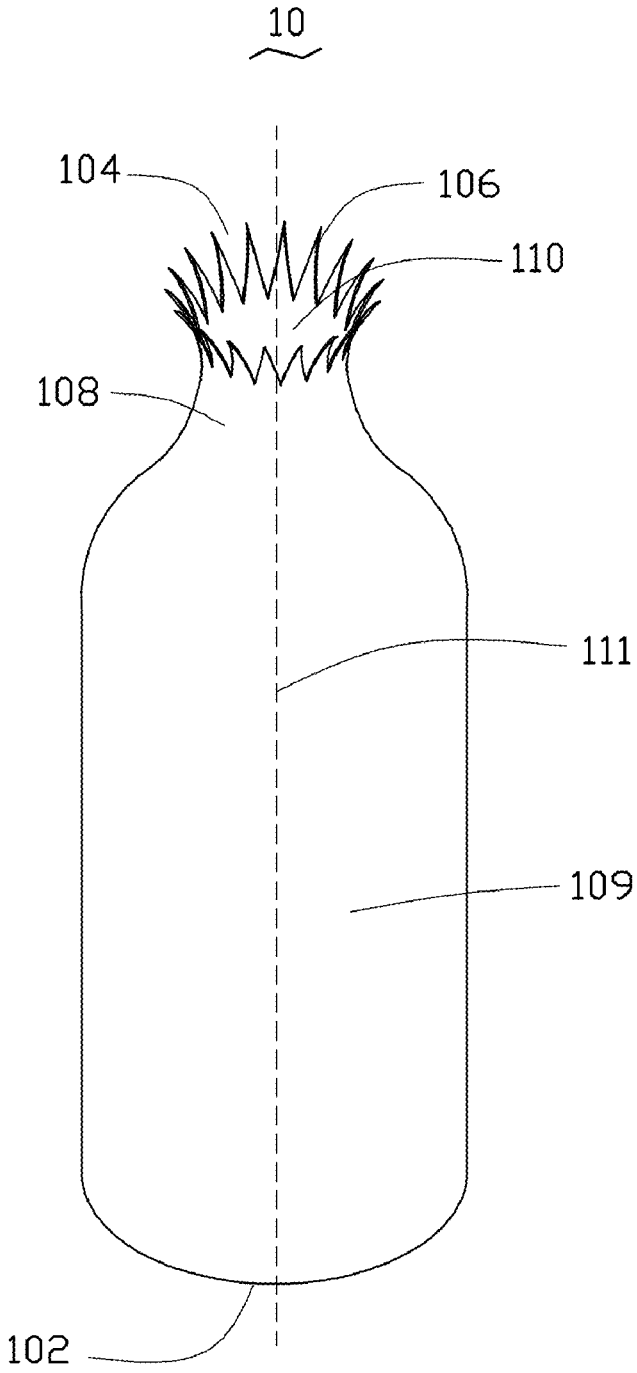
FIG. 1 is a schematic structural view of one embodiment of an electron emitter.
Figure 2:
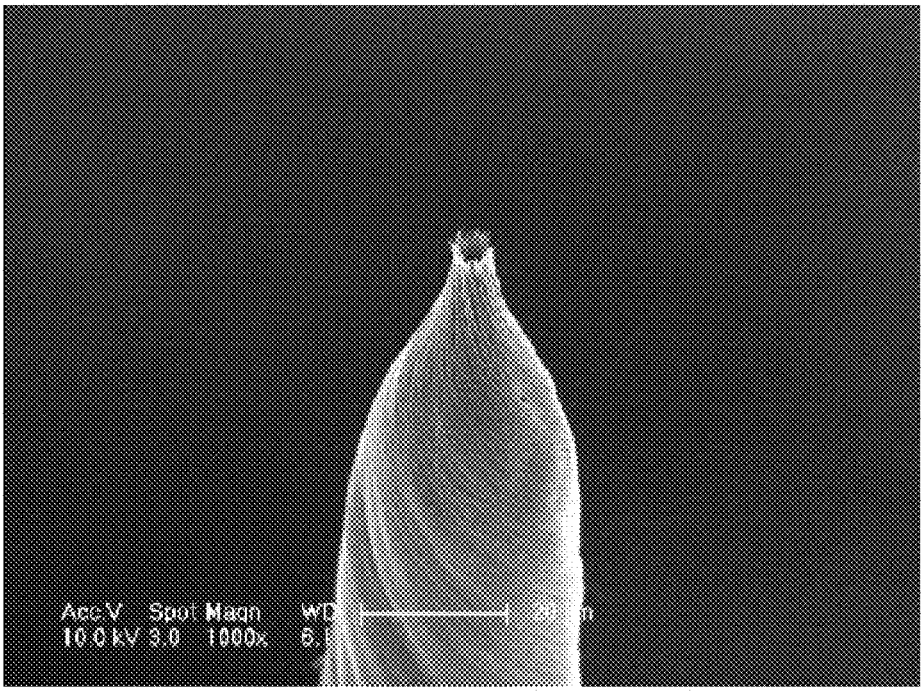
FIG. 2 is a Scanning Electron Microscope (SEM) image of one embodiment of an electron emitter.
Figure 3:
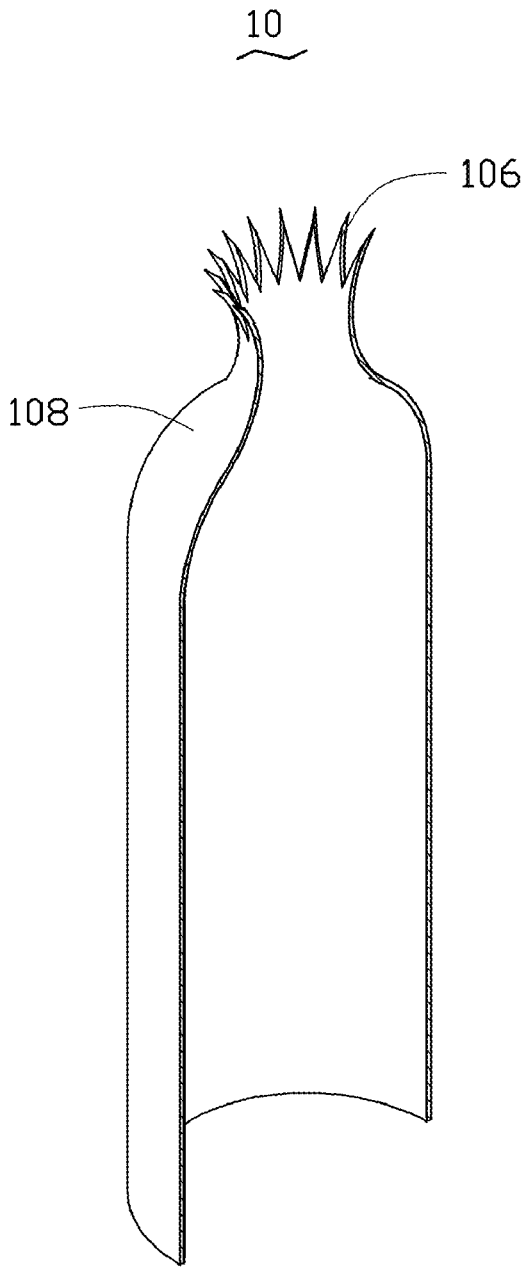
FIG. 3 is a schematic, cross-sectional view, along an axial direction of FIG. 1.
Figure 4:
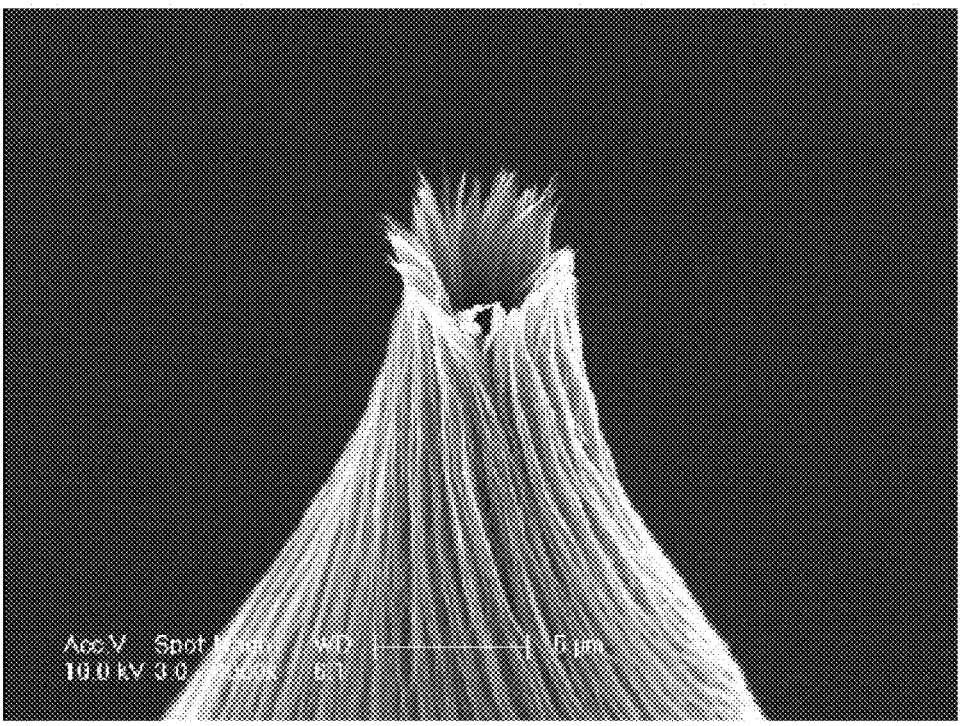
FIG. 4 is a SEM image of one embodiment of one end of an electron emitter.
Figure 5:
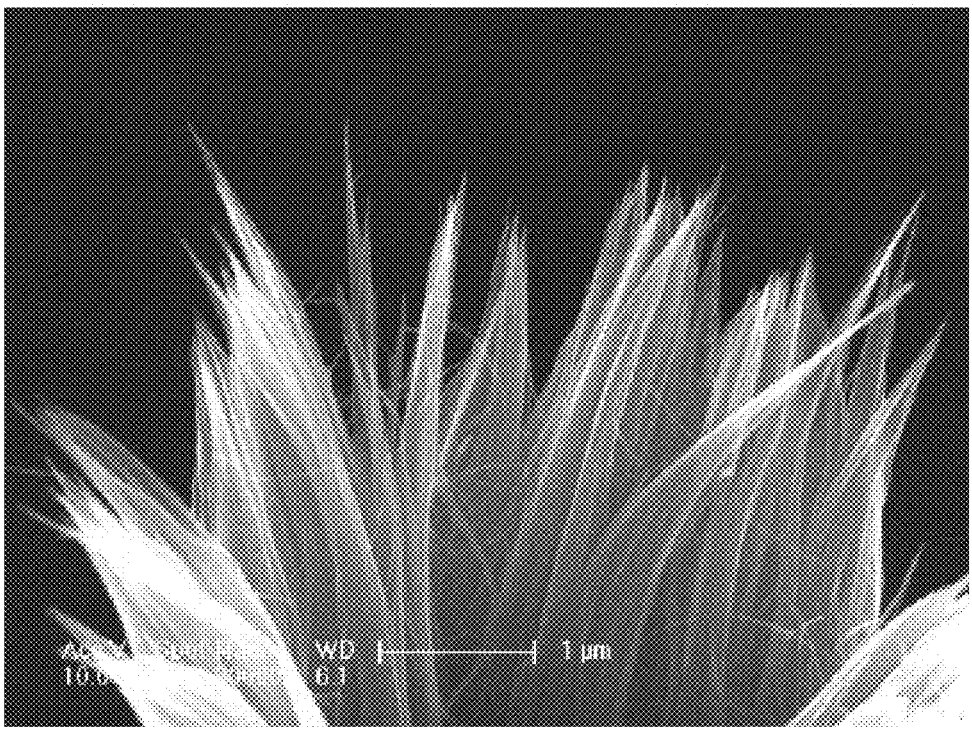
FIG. 5 is a SEM image of one embodiment of a number of carbon nanotube peaks of an electron emitter.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present electron emitter, a method for making the same, and an electron emission element using the same.

Referring to FIGS. 1 to 5, the electron emitter 10 of one embodiment includes a carbon nanotube pipe. The length of the carbon nanotube pipe can be selected according to need. The cross section of the carbon nanotube pipe can be circular, ellipsoid, quadrangular, triangular, or polygonal. The carbon nanotube pipe includes a number of carbon nanotubes joined by van der Waals attractive force. In one embodiment, the carbon nanotube pipe includes a number of successive and oriented carbon nanotubes. Most of the carbon nanotubes are helically oriented around an axis 111 of the carbon nanotube pipe. The carbon nanotube pipe may have a few carbon nanotubes not helically oriented around the axis 111, but oriented disorderly and randomly. The helically oriented carbon nanotubes are joined end-to-end by van der Waals attractive force therebetween along a helically extending direction. An angle $\alpha$ between the helically extending direction and the axis 111 can be greater than 0 degrees and less than or equal to 90 degrees. In one embodiment, the angle $\alpha$ between the helically extending direction and the axis 111 is greater than or equal to 30 degrees and less than or equal to 60 degrees.

The electron emitter 10 is a carbon nanotube pipe including a first end 102, a second end 104 oriented to the first end 102, and a main body 109 connecting the first end 102 and the second end 104. The second end 104 is used as an electron emission portion. The second end 104 defines an opening 110 and includes a hollow neck portion 108 connected to the body 109. A number of carbon nanotube peaks 106 extend from a top of the hollow neck portion 108 to enclose the opening 110. The carbon nanotube peaks 106 are located around the opening 110 and spaced from each other. The diameter of the hollow neck portion 108 gradually diminishes along a direction apart from the first end 102 and forms a conical-shape. When an electric voltage is applied to the electron emitter 10, the electric field will be concentrated at the hollow neck portion 108 to help the electron emitter 10 emit electrons. The carbon nanotube peaks 106 are located around an axis 111 of the carbon nanotube pipe and spaced from each other to form a ring shape. Each of the carbon nanotube peaks 106 is a tapered carbon nanotube bundle and functions as an electron emitter. The carbon nanotube peaks 106 can extend along a same direction substantially parallel with the axis 111. The carbon nanotube peaks 106 point to a direction far away from the first end 102 of the electron emitter 10. The carbon nanotube peaks 106 can also extend along different directions across the axis 111 to form a radial shape. If the carbon nanotube peaks 106 form a radial shape, the size of the opening 110 of the second end 104 gradually increases where the neck portion 108 connects to the carbon nanotube peaks 106. The distance between two adjacent carbon nanotube peaks 106 gradually increases. Thus, the screening effect between the carbon nanotube peaks 106 is reduced. The effective diameter of the opening 110 where the neck portion 108 connects with the carbon nanotube peaks 106 can be in a range from about 4 micrometers to about 6 micrometers. In one embodiment, the opening 110 is round and has a diameter of about 5 micrometers.

Figure 6:
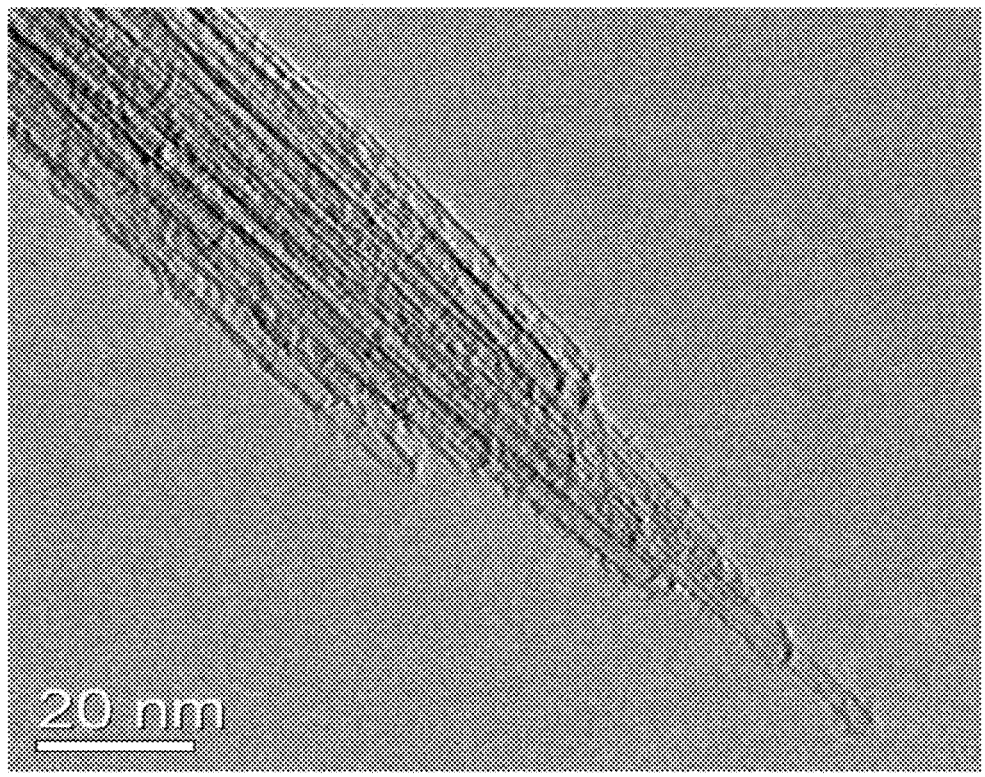
FIG. 6 is a transmission electron microscope (TEM) image of one embodiment of a carbon nanotube peak of an electron emitter.

Referring also to FIG. 6, the carbon nanotube peak 106 includes a number of carbon nanotubes substantially parallel to each other and joined by van der Waals attractive force. A single projecting carbon nanotube is taller than and projects over other carbon nanotubes in the carbon nanotube peak 106. The single projecting carbon nanotube can be located within the middle of the other carbon nanotubes. The diameter of the carbon nanotubes is less than 5 nanometers, and the number of graphite layers of each carbon nanotube is about 2 to 3. In one embodiment, the diameter of the carbon nanotubes is less than 4 nanometers. Therefore, the aspect ratio of the carbon nanotubes in the carbon nanotube peaks is increased and the field enhancement factor of the carbon nanotube peaks is increased too. The distance of the projecting carbon nanotubes of two adjacent carbon nanotube peaks 106 can be in a range from about 0.1 micrometers to about 2 micrometers. The ratio of the distance between the projecting carbon nanotubes and the diameter of the carbon nanotubes can be in a range from about 20:1 to about 500:1. Because the distance between the projecting carbon nanotubes is much greater than the diameter of the carbon nanotubes, the screening effect between the projecting carbon nanotubes is reduced.

The carbon nanotube pipe can be formed by closely wrapping a carbon nanotube film or a carbon nanotube wire around the axis 111. The carbon nanotube film or carbon nanotube wire can be wrapped layer upon layer. The thickness of the wall of the carbon nanotube pipe can be determined by the number of the layers. The inner diameter and outer diameter of the main body 109 of the carbon nanotube pipe can be selected according to need. The inner diameter of the carbon nanotube pipe can be in a range from about 10 micrometers to about 30 micrometers. The outer diameter of the carbon nanotube pipe can be in a range from about 15 micrometers to about 60 micrometers. In one embodiment, the inner diameter of the main body 109 of the carbon nanotube pipe is about 18 micrometers, and the outer diameter of the main body 109 of the carbon nanotube pipe is about 50 micrometers.

The electron emitter 10 can be applied to a field emission device such as a field emission display, a SEM, or a TEM. The field emission display has at least one cathode and at least one anode. The first end 102 of the electron emitter 10 can be connected to the cathode. The second end 104 of the electron emitter 10 points to the anode. When a voltage is applied between the electron emitter 10 and the anode, the electron emitter 10 can emit electrons under the voltage.

A method for making the electron emitter 10 includes the following steps:

S10, providing a linear support;

S20, providing at lease one carbon nanotube film or at least one carbon nanotube wire;

S30, wrapping the at lease one carbon nanotube film or wire around the linear support;

S40, removing the linear support to obtain a carbon nanotube hollow cylinder;

S50, fusing the carbon nanotube hollow cylinder.

In the step S10, the linear support is configured to support the at least one carbon nanotube film or wire. Thus the linear support should have a certain strength and toughness. The linear support can move forward along an axial direction of the linear support and rotate around the axial direction of the linear support simultaneously. In addition, the linear support should be easily removed by a chemical method or a physical method. The material of the linear support can be metal, alloy, or plastics. The metal can be gold, silver, copper, or aluminum. The alloy can be a copper-tin alloy. In one embodiment, the linear structure is a copper-tin alloy wire including about 97 wt. % copper and about 3 wt. % tin. In one embodiment, the linear support can be a gold thread. A diameter of the gold thread is according to need. In one embodiment, the diameter of the gold thread is 18 micrometers.

In the step S20, the at least one carbon nanotube film or wire can be a free-standing structure. The carbon nanotube film can be a drawn carbon nanotube film, a flocculated carbon nanotube film, a pressed carbon nanotube film, or a carbon nanotube film formed by spraying, coating, or deposition. The carbon nanotube film includes a number of carbon nanotubes distributed uniformly and attracted by van der Waals attractive force therebetween. The carbon nanotubes in the carbon nanotube film can be orderly or disorderly aligned. The orderly aligned carbon nanotubes are arranged in a consistently systematic manner, e.g., most of the carbon nanotubes are arranged approximately along a same direction or have two or more sections within each of which the most of the carbon nanotubes are arranged approximately along a same direction (different sections can have different directions). The disorderly aligned carbon nanotubes are arranged along many different directions, such that the number of carbon nanotubes arranged along each different direction can be almost the same (e.g. uniformly disordered), and/or entangled with each other.

If the carbon nanotube film in the step S20 is a drawn carbon nanotube film or a carbon nanotubewire, the step S20 can further includes the following substeps:

S210, providing a carbon nanotube array; and

S220, drawing a carbon nanotube film or a carbon nanotube wire from the carbon nanotube array.

In the step S210, the carbon nanotube array 10 can be located on a substrate. The carbon nanotube array includes a number of carbon nanotubes. The number of carbon nanotubes in the carbon nanotube array can be approximately perpendicular to the substrate. The carbon nanotubes in the carbon nanotube array can be single-walled carbon nanotubes, double-walled carbon nanotubes, or multi-walled carbon nanotubes. The carbon nanotube array can be a super-aligned carbon nanotube array. The carbon nanotube array can be prepared by a chemical vapor deposition method, an arc discharge method, or a laser ablation method.

In the S220, the carbon nanotube film can be formed by the substeps of:

S222, selecting one or more carbon nanotubes having a predetermined width from the super-aligned array of carbon nanotubes; and S224, pulling the carbon nanotubes to form carbon nanotube segments that are joined end to end at an uniform speed to achieve a uniform carbon nanotube film.

In step S222, the carbon nanotube segments having a predetermined width can be selected by using a tool such as an adhesive tape, tweezers, or a clamp to contact the super-aligned array.

In step S224, the pulling direction is substantially perpendicular to the growing direction of the super-aligned array of carbon nanotubes. Each carbon nanotube segment includes a number of carbon nanotubes substantially parallel to each other.

More specifically, during the pulling process, as the initial carbon nanotube segments are drawn out, other carbon nanotube segments are also drawn out end to end due to van der Waals attractive force between ends of adjacent segments. This process of drawing ensures a substantially continuous and uniform carbon nanotube film having a predetermined width can be formed. The carbon nanotube film includes a number of carbon nanotubes joined ends to ends. The carbon nanotubes in the carbon nanotube film are all substantially parallel to the pulling/drawing direction of the carbon nanotube film, and the carbon nanotube film produced in such manner can be selectively formed to have a predetermined width. If the width of the carbon nanotube film is narrow enough, the carbon nanotube film can be used as the carbon nanotube wire.

In the S30, a method for wrapping the at least one carbon nanotube film or wire around the linear support includes the following substeps:

S310, fixing one end of the carbon nanotube film or wire to the linear support; and S320, making a relative rotation between the linear support and the carbon nanotube film or wire, and simultaneously moving the linear support along an axial direction of the linear support.

During the step S320, an angle β between the extending direction of the carbon nanotubes in the film or wire and the axial direction of the linear support can be greater than 0 degrees and less than 90 degrees. The carbon nanotube film or wire wrapping around the linear support forms a carbon nanotube layer. When the thickness of the carbon nanotube film or wire is predetermined, the greater the angle β, the thicker the carbon nanotube layer. In one embodiment, the thickness of the carbon nanotube layer is 6 micrometers.

The step S40 can be performed by a chemical method or a physical method, such as a mechanical method. If the linear support is made of an active metal or an alloy composed of active metals, such as iron or aluminum, the step S40 can include a step of reacting the linear support with an acid liquid. If the material of the linear support is an inactive metal or an alloy includes inactive metals, such as gold or silver, the step S40 can be performed by heating to evaporate. If the material of the linear support is a polymer material, the step S40 can include a step of pulling the linear support out from the carbon nanotube layer using a stretching device along the axial direction of the linear support. Therefore, the shape and effective diameter of the linear support can decide the figure and effective inner diameter of the carbon nanotube hollow cylinder. In one embodiment, the linear support is a gold thread. A method for removing the gold thread can include the following steps of connecting the two ends of the gold thread to two electrodes, applying a current to the gold thread by the two electrodes in a vacuum, and heating the gold thread until the gold thread is evaporated.

In one embodiment, after the step S30 and before the step S40, the carbon nanotube hollow cylinder can be treated by an organic solvent.

Figure 7:
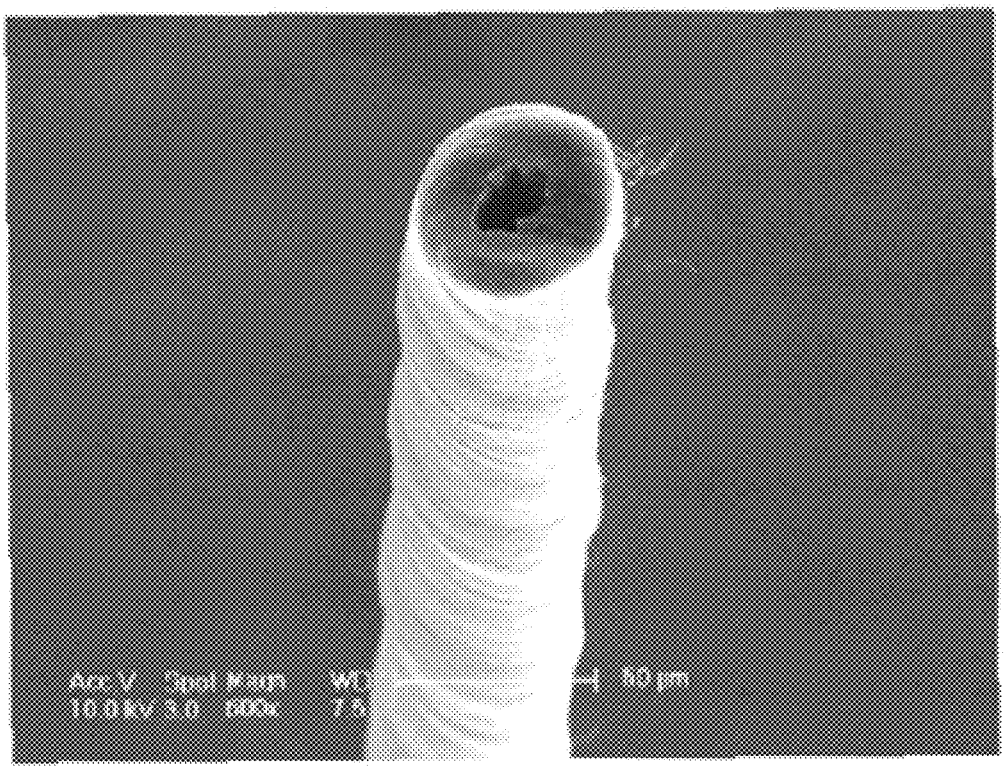
FIG. 7 is a SEM image of one embodiment of a carbon nanotube hollow cylinder.

Referring to FIG. 7, the carbon nanotube hollow cylinder includes a number of successive and oriented carbon nanotubes. Most of the carbon nanotubes are helically oriented around an axial direction of the carbon nanotube hollow cylinder. The helically oriented carbon nanotubes are joined end-to-end by van der Waals attractive force therebetween along a helically extending direction. The carbon nanotube hollow cylinder may have a few carbon nanotubes not helically oriented around the axial direction, but oriented disorderly and randomly. The angle between the helically extending direction and the centerline of the carbon nanotube hollow cylinder can be greater than 0 degrees and less than or equal to 90 degrees.

In the step S50, the carbon nanotube hollow cylinder can be fused by laser scanning, electron beam irradiation, ion beam irradiation, heating by supplying a current, and/or laser-assisted fusing after supplying current.

If the carbon nanotube hollow cylinder is fused by heating by supplying a current, the S50 can include the following substeps:

S512, placing the carbon nanotube hollow cylinder in a vacuum chamber or a chamber filled with inert gas; and S514, applying a voltage between two opposite ends of the carbon nanotube hollow cylinder, until the carbon nanotube hollow cylinder snaps at a certain point.

In the step S512, the vacuum chamber includes an anode and a cathode, which lead (i.e., run) from inside to outside of the vacuum chamber. Two opposite ends of thye carbon nanotube hollow cylinder are attached to and electrically connected to the anode and the cathode, respectively. The pressure of the vacuum chamber is less than $2\times10^{-5}$ Pascal (Pa). In one embodiment, the pressure of the vacuum chamber is about $2\times10^{-5}$ Pa.

The structure of the chamber filled with inert gas is the same as the vacuum chamber. The inert gas can be helium or argon.

In the step S514, the voltage depends on the inner diameter, outer diameter, and the length of the carbon nanotube hollow cylinder. In one embodiment, the carbon nanotube hollow cylinder is about 2 centimeters in length, about 25 micrometers in the inner diameter, and about 40 micrometers in the outer diameter, and a 40 V direct current (DC) voltage applied. Consequently, the carbon nanotube hollow cylinder is heated by Joule-heating, and a temperature of the carbon nanotube hollow cylinder can reach an approximate range from 2000 Kelvin (K) to 2400 K. The resistance along the longitudinal axial of the carbon nanotube hollow cylinder is different, and thus the temperature distribution along the longitudinal axial of the carbon nanotube hollow cylinder is different. The greater the resistance and higher the temperature, the more easily it snaps. In one embodiment, after less than 1 hour (h), the carbon nanotube hollow cylinder snaps at a certain point to form two carbon nanotube pipes.

During snapping, some carbon atoms vaporize from the snapping portion of the carbon nanotube hollow cylinder. Each snapped carbon nanotube hollow cylinder has a break-end portion. The closer to the snapping position, the more carbon atoms are evaporated. Therefore, the neck portion is formed on the break-end portion of the snapped carbon nanotube hollow cylinder. After snapping, a micro-fissure is formed between the two break-ends, arc discharge may occur between the micro-fissure, and the carbon atoms are transformed into carbon ions due to ionization. These carbon ions bombard or etch the break-end portion to form a number of carbon nanotube peaks 106. A wall by wall breakdown of carbon nanotubes is caused by the Joule-heating at a temperature higher than 2000K. The carbon nanotubes at the broken ends have smaller diameters and a fewer number of graphite layers.

If the carbon nanotube hollow cylinder is fused by the electron emitter bombarding method, the S50 can include the following substeps:

S522, putting the carbon nanotube hollow cylinder in a vacuum chamber;

S524, applying a voltage between two opposite ends of the carbon nanotube hollow cylinder and heating the carbon nanotube hollow cylinder to a temperature of about 1800K to about 2500K; and S526, bombarding a predetermined point of the carbon nanotube hollow cylinder by an electron beam, until the carbon nanotube hollow cylinder snaps.

In the step S522, the pressure of the vacuum chamber is less than $1\times10^{-4}$ Pascal (Pa). In one embodiment, he pressure of the vacuum chamber is about $1\times10^{-5}$ Pa.

In the step S526, the electron beam can be emitted by an electron source, such as a carbon nanotube wire, a hot cathode, or any other field emission electron sources. A number of electron sources can be used together to obtain a larger electron current. The electron source is used to bombard a predetermined point of the carbon nanotube hollow cylinder. The predetermined point is located along the longitudinal axis of the carbon nanotube hollow cylinder. The electron source is arranged in the vacuum chamber. A distance between the electron source and the carbon nanotube hollow cylinder is in an approximate range from 50 micrometers to 2 millimeters (mm), typically, about 50 micrometers. The electron source can be in any direction, only if the electron source can bombard the predetermined point. With the electron bombarding, a temperature of the predetermined point is enhanced, and thus the temperature thereof is higher than the other points along the longitudinal axis of the carbon nanotube hollow cylinder. Consequently, the carbon nanotube hollow cylinder previously snaps at the predetermined point, and then two electron emitters 10 are formed.

If the carbon nanotube hollow cylinder is fused by the laser beam, the S50 can include the following substeps:

S532, irradiating a predetermined point of the carbon nanotube hollow cylinder with a laser beam; and S534, applying a voltage between two opposite ends of the carbon nanotube hollow cylinder, until the carbon nanotube hollow cylinder snaps.

In the step S532, the carbon nanotube hollow cylinder can be located in a gas. The gas can be air or oxidizing gas.

The laser beam can be a carbon dioxide laser, semiconductor laser, UV laser, or any other laser. A power of the laser beam is in a range from about 1 watt to about 12 watts, and a scanning velocity thereof is in a range from about 100 mm/s to about 2000 mm/s. In one embodiment, the power of the laser beam is about 12 watts, and the scanning velocity thereof is about 1000 mm/S. The greater the power of the laser beam, the shorter the time that the laser beam irradiates the carbon nanotube hollow cylinder.

In the step S534, the carbon nanotube hollow cylinder can be placed in a vacuum chamber or a chamber filled with inert gas. Due to the heat of the laser beam, the carbon nanotube hollow cylinder is oxidized at the predetermined point, with some defects formed thereat, and thus the resistance at the predetermined point increases. The greater the resistance and higher the temperature, the more easily it snaps. The carbon nanotube hollow cylinder will be snapped at the predetermined point.

The step S532 and the step S534 can be implemented simultaneously when the carbon nanotube hollow cylinder is placed in a vacuum chamber or a chamber filled with inert gas.

The above-described method for making the electron emitter 10 is simple and the efficiency of making the electron emitter 10 can be improved. By the provision of the carbon nanotube peaks formed on the break-end of the carbon nanotube pipe, the field emission characteristic of the carbon nanotube pipe is improved.

Figure 8:
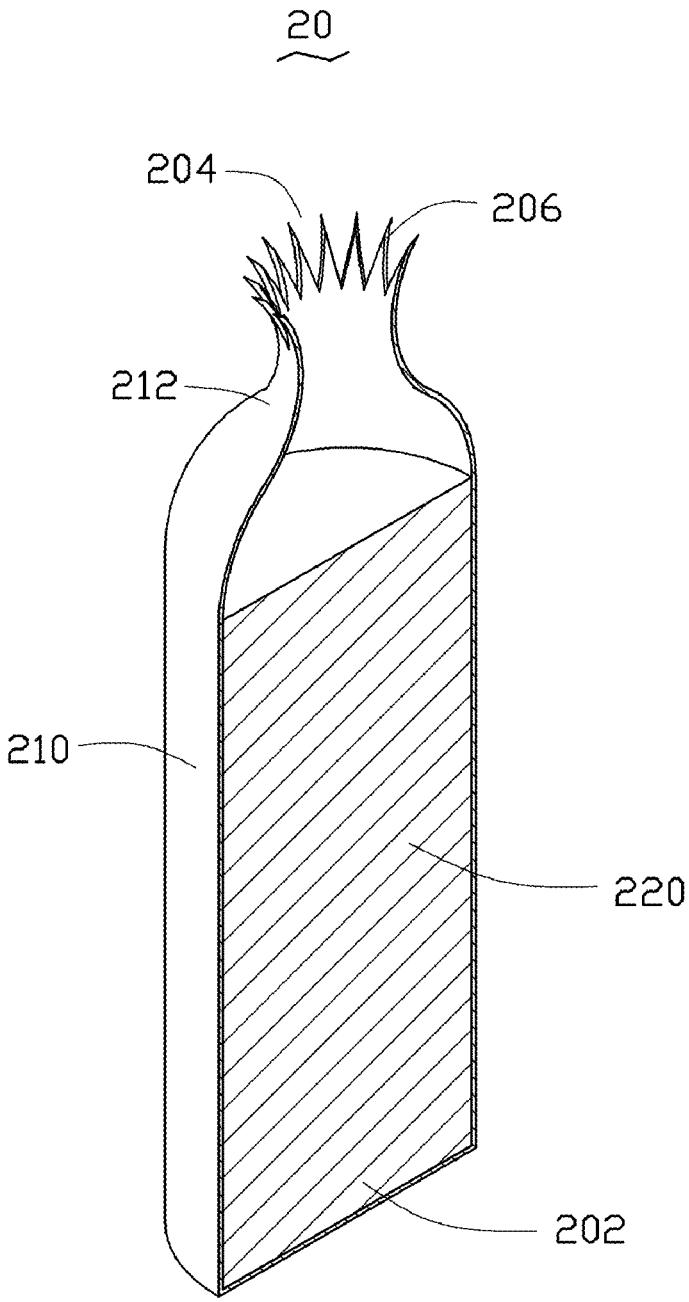
FIG. 8 is a schematic, cross-sectional view, along an axial direction of one embodiment of an electron emitter.

Referring to FIG. 8, an electron emitter 20 of one embodiment includes a carbon nanotube linear compound. The carbon nanotube linear compound includes a conductive linear support 220 and a carbon nanotube layer. The carbon nanotube layer is located on a surface of the conductive linear support 220 and around the conductive linear support 220 to form a carbon nanotube pipe 210. The carbon nanotube pipe 210 includes a first end 204 and a second end 202. The first end 204 of the carbon nanotube pipe 210 includes a hollow neck portion 212 and a number of carbon nanotube peaks 206 extending from a top of the hollow neck portion 212. The conductive linear support 220 is located in the carbon nanotube pipe 210 and encased by the carbon nanotube pipe 210. The length of the conductive linear support 220 can be shorter than that of the carbon nanotube pipe 210. The conductive linear support 220 can also extend out of the carbon nanotube pipe 210 from the second end 202. The structure of the electron emitter 20 is similar to the structure of the electron emitter 10, the difference being that the electron emitter 20 further includes the conductive linear support 220.

The conductive linear support 220 is configured to support the carbon nanotube pipe and improve the electric conductivity of the electron emitter 20. Therefore, field emission characteristic of the electron emitter 20 is improved. The conductive linear support 220 can be made of conductive material. The conductive linear support 220 can be made of metal, alloy, or a linear structure coating a layer of conductive material. The metal can be gold, silver, copper, or aluminum. In one embodiment, the linear support is a gold thread. The diameter of the conductive linear support 220 can be in a range from about 10 micrometers to about 30 micrometers. In one embodiment, the conductive linear support 220 is a metal wire and the diameter of the metal wire is 18 micrometers.

A method for making the electron emitter 20 includes the following steps:

S100, providing a conductive linear support;

S200, providing at lease one carbon nanotube film or wire;

S300, wrapping the at lease one carbon nanotube film or wire around the conductive linear support to form a carbon nanotube linear compound; and S400, fusing the carbon nanotube linear compound.

The method for making the electron emitter 20 is similar to the method for making the electron emitter 10. The method for wrapping the at lease one carbon nanotube film or wire and the fusing method are identical between the two methods for making the electron emitters 10, 20 described previously. The difference is that the linear support for making the electron emitter 10 can be made of insulated material but the conductive linear support is used to make the electron emitter 20. Furthermore, the conductive linear support cannot be removed before the fusing step in the method for making the electron emitter 20.

The melting point of the carbon nanotube pipe and the conductive linear support may be different. During the fusing process, the carbon nanotube pipe and the conductive linear support are heated to a very high temperature. If the melting point of the carbon nanotube pipe is lower than that of the conductive linear support, the carbon nanotube pipe will be first snapped at a predetermined point under the current, the laser, or electron beams. After the carbon nanotube pipe is snapped, the resistance of the conductive linear support corresponding to the snapped point of the carbon nanotube pipe will be raised. The greater the resistance, the higher the temperature. Therefore, the carbon nanotube pipe and the conductive linear support will be snapped at the same point. It is can be understood that if the melting point of the conductive linear support is lower than that of the carbon nanotube pipe, the conductive linear support and the carbon nanotube pipe can also be snapped at the same point.

The method for making the electron emitter 20 has the following benefits. First, the method for making electron emitter 20 is simple and the efficiency of making the electron emitter 20 can be improved. Second, the carbon nanotube peaks are formed on one end of the carbon nanotube pipe, therefore the field emission characteristic of the electron emitter is improved. A conductive linear structure is located in the interior of the carbon nanotube pipe to support the carbon nanotube pipe. The electric conductivity of the electron emitter 20 is improved for the conductive linear structure.

Figure 9:
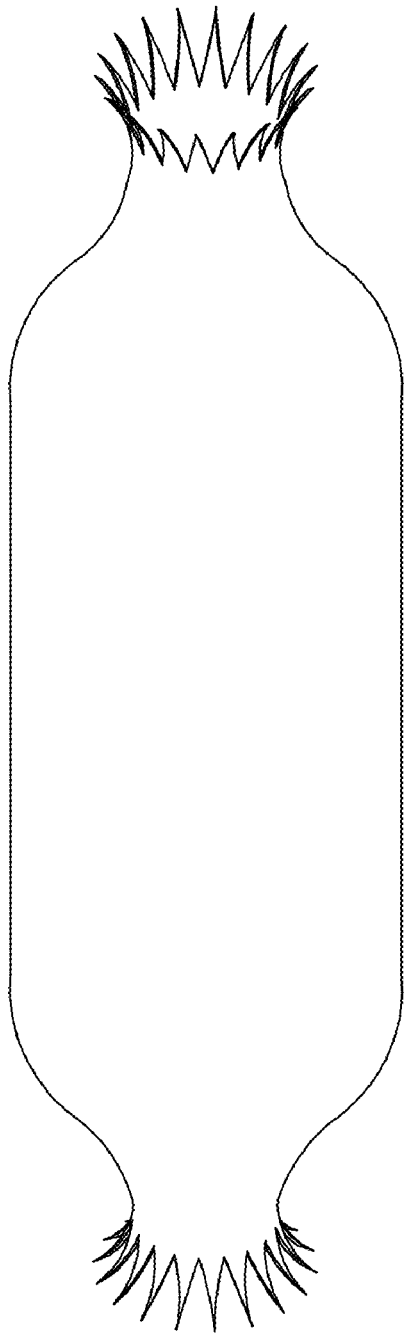
FIG. 9 is a schematic structural view of one embodiment of an electron emitter.

Referring to FIG. 9, an electron emitter of one embodiment includes a carbon nanotube pipe. The electron emitter is a carbon nanotube pipe including a first end, a second end opposite to the first end, and a main body connecting the first end and the second end. Both of the second end and the first end can be used as electron emission portions. Both of the second end and the first end include a hollow neck portion connected to the body and a number of carbon nanotube peaks extending from a top of the hollow neck portion. The structure of the electron emitter shown in the FIG. 9 is similar to the structure of the electron emitter shown in FIG. 1, the difference being that the two ends of the electron emitter shown in the FIG. 9 include a number of carbon nanotube peaks.

Figure 10:
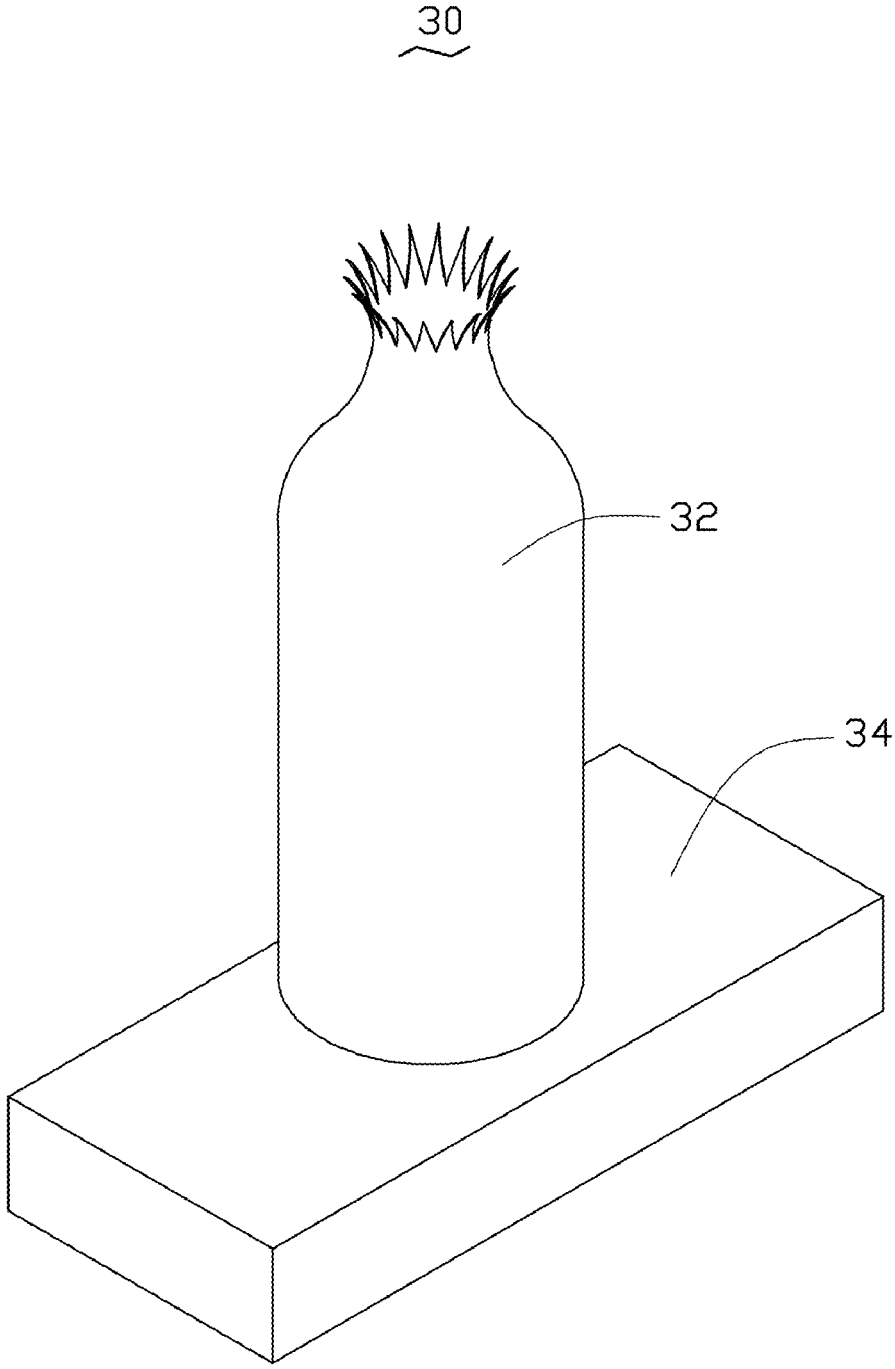
FIG. 10 is a schematic structural view of one embodiment of an electron emission element.

Referring to FIG. 10, an electron emission element 30 of one embodiment includes a conductive base 34 and an electron emitter 32. The electron emitter 32 has two ends. One end of the electron emitter 32 is electrically connected with the conductive base 34. The end of the electron emitter 32 can be attached to the conductive base 34 by a conductive adhesive or van der Walls attractive force.

The conductive base 34 can be made of metal or alloy. The metal alloy can be copper, tungsten, gold, molybdenum, or platinum. The shape of the conductive base 34 can be tapered-shaped, cylinder-shaped, or rotary-table. The conductive base 34 can be an insulated substrate coated with a conductive film. The conductive base 34 can also be a cathode of a field emission display.

In one embodiment, the electron emitter 32 can include only one carbon nanotube pipe. A number of carbon nanotube peaks extends from one end of the carbon nanotube pipe. An angle between the electron emitter 32 and a surface of the conductive base 34 from which the electron emitter 32 attached, can be in a range from about 0 degrees to about 90 degrees.

In one embodiment, the electron emitter 32 includes a carbon nanotube pipe and a conductive linear structure. The conductive linear structure can in direct electrical contact with the conductive base. The conductive linear structure can be soldered on the conductive base. The conductive linear structure and the conductive base can also be one-body formed.

In one embodiment, the electron emission element 30 includes a number of electron emitters 32 located on the conductive base 34. Each of the electron emitters 32 is in direct electrical contact with the conductive base 34. The electron emitters 32 are spaced apart from each other. Furthermore, the electron emitter 32 can be located substantially parallel with each other, or intersected with each other. The electron emitter 32 can improve the current density of the electron emission element 30.

The electron emission element 30 has the following benefits. First, the electron emitter include a number of carbon nanotube peaks, and the electron emitter has a bigger current density when applied. Second, a number of carbon nanotube peaks extends from a carbon nanotube pipe of the electron emitter, therefore screening effect is reduced. Third, the carbon nanotube peaks are tapered so that the field enhancement factor of the carbon nanotube peaks is improved, and thus the filed emission characteristic of the electron emission element 30 is improved.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An electron emitter comprising a carbon nanotube pipe defining a hollow axial center and comprising a first end having a plurality of carbon nanotube peaks.

2. The electron emitter of claim 1, wherein the carbon nanotube pipe further comprises a plurality of carbon nanotubes surrounding an axis of the carbon nanotube pipe, a second end, and a main body connecting the first end and the second end.

3. The electron emitter of claim 2, wherein the first end defines an opening and comprises a hollow neck portion connected to the main body.

4. The electron emitter of claim 3, wherein the plurality of carbon nanotube peaks extends from a top of the neck portion to enclose the opening.

5. The electron emitter of claim 4, wherein an effective diameter of the opening where the hollow neck portion connects with the carbon nanotube peaks is in a range from about 4 micrometers to about 6 micrometers.

6. The electron emitter of claim 3, wherein a diameter of the hollow neck portion gradually diminishes along a direction apart from the second end.

7. The electron emitter of claim 1, wherein the plurality of carbon nanotube peaks is located around an axis of the carbon nanotube pipe and spaced from each other to form a ring shape.

8. The electron emitter of claim 7, wherein the plurality of carbon nanotube peaks extends along a same direction substantially parallel with the axis.

9. The electron emitter of claim 7, wherein the carbon nanotube peaks extend along different directions across the axis to form a radial shape.

10. The electron emitter of claim 9, wherein a distance between two adjacent carbon nanotube peaks gradually increases.

11. The electron emitter of claim 1, wherein each of the plurality of carbon nanotube peaks comprises a plurality of carbon nanotubes substantially parallel to each other and joined by van der Waals attractive force.

12. The electron emitter of claim 11, wherein each of the plurality of carbon nanotube peaks is a tapered carbon nanotube bundle, and a single projecting carbon nanotube is taller than and projects over other carbon nanotubes in each of the plurality of carbon nanotube peaks.

13. The electron emitter of claim 12, wherein the single projecting carbon nanotube is located in a middle of the other carbon nanotubes.

14. The electron emitter of claim 13, wherein a distance of the projecting carbon nanotubes of two adjacent carbon nanotube peaks is in a range from about 0.1 micrometers to about 2 micrometers.

15. The electron emitter of claim 14, wherein a ratio of the distance between the projecting carbon nanotubes of two adjacent carbon nanotube peaks and a diameter of the carbon nanotubes is in a range from about 20:1 to about 500:1.

16. The electron emitter of claim 1, wherein the carbon nanotube pipe comprises a plurality of successive carbon nanotubes helically oriented around an axis of the carbon nanotube pipe, and joined end-to-end by van der Waals attractive force therebetween along a helically extending direction.

17. The electron emitter of claim 16, wherein an angle between the helically extending direction and the axis is in a range from about 30 degrees to about 60 degrees.

18. The electron emitter of claim 1, wherein the carbon nanotube pipe further comprises a second end defining an opening and comprising a plurality of carbon nanotube peaks surrounding the opening, and the first end defines an opening surrounded by the carbon nanotube peaks of the first end.

19. An electron emitter, comprising a carbon nanotube pipe defining a hollow axial center and having one end comprising a plurality of tapered carbon nanotube bundles located around the hollow axial center of the carbon nanotube pipe and spaced from each other to form a ring shape.

20. An electron emitter comprising a carbon nanotube pipe defining a hollow axial center and comprising a first end and a second end, and at least one of the first end and the second end defining an opening and comprising a plurality of tapered carbon nanotube bundles surrounding the opening.

* * * * *